US006920305B2

(12) United States Patent
Byun et al.

(10) Patent No.: US 6,920,305 B2
(45) Date of Patent: Jul. 19, 2005

(54) DEVICE FOR AND METHOD OF CLEANING PHOTORECEPTOR MEDIUM OF ELECTROPHOTOGRAPHIC IMAGE FORMING APPARATUS

(75) Inventors: Seung-young Byun, Gyeonggi-do (KR); Jun-hee Cho, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/231,056

(22) Filed: Aug. 30, 2002

(65) Prior Publication Data

US 2003/0156870 A1 Aug. 21, 2003

(30) Foreign Application Priority Data

Feb. 21, 2002 (KR) ..... 2002-9286

(51) Int. Cl.[7] ..... G03G 21/00
(52) U.S. Cl. ..... 399/356
(58) Field of Search ..... 399/343, 346, 399/348, 356, 99, 149, 150, 264, 296, 104; 134/104.1, 115 R, 116, 148, 153

(56) References Cited

U.S. PATENT DOCUMENTS 3,981,844 A * 9/1976 Romankiw
4,007,982 A * 2/1977 Stange
4,111,546 A * 9/1978 Maret
4,211,484 A * 7/1980 Iwai et al.
5,799,233 A * 8/1998 Ishii et al.

FOREIGN PATENT DOCUMENTS

| | | | | |
|---|---|---|---|---|
| EP | 0361509 A2 | * | 4/1990 | ..... G03G/21/00 |
| JP | 54037750 A | * | 3/1979 | ..... G03G/21/00 |
| JP | 55105272 A | * | 8/1980 | ..... G03G/21/00 |
| JP | 61090184 A | * | 5/1986 | ..... G03G/21/00 |

OTHER PUBLICATIONS

Translation of JP54–037750 (Otomura et al.).*

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

A device for and a method of cleaning a photoreceptor medium of an electrophotographic image forming apparatus include a magnet which is installed in a lengthwise direction of the photoreceptor medium and is separated from an outer surface of the photoreceptor medium, and a magnetic fluid which fills a space between the magnet and the outer surface of the photoreceptor medium and closely contacts the outer surface of the photoreceptor medium. Accordingly, abrasion of the photoreceptor medium can be prevented, and since the developer does not stick to the magnetic fluid, a decrease in a cleaning efficiency can be prevented.

21 Claims, 3 Drawing Sheets

DEVICE FOR AND METHOD OF CLEANING PHOTORECEPTOR MEDIUM OF ELECTROPHOTOGRAPHIC IMAGE FORMING APPARATUS

CROSS-REFERENCE TO RELATED APPLICATIONS

This application claims the benefit of Korean Patent Application No. 2002-9286, filed Feb. 21, 2002, in the Korean Industrial Property Office, the disclosure of which is incorporated herein by reference.

BACKGROUND OF THE INVENTION

1. Field of the Invention

The present invention relates to an electrophotographic image forming apparatus, and more particularly, to a photoreceptor medium cleaning device and a method of preventing print quality from being degraded due to a developer which remains on an outer surface of a photoreceptor medium.

2. Description of the Related Art

Generally, an electrophotographic image forming apparatus forms a latent electrostatic image on a photoreceptor medium such as a photoreceptor drum or photoreceptor belt, develops the latent electrostatic image with toner of predetermined colors, and transfers the latent electrostatic image to print paper to form a predetermined image.

A conventional wet electrophotographic image forming apparatus includes a development unit which applies a developer to a latent electrostatic image, which is formed on the photoreceptor medium by a laser scanning unit (LSU), to form a desired image on the photoreceptor medium, a transfer unit which transfers the image to the print paper, and a fusing and fixing unit which fuses and fixes the transferred image onto the print paper.

The development unit includes a developer roller which faces the photoreceptor medium and rotates with its part in the developer that is contained in a developer container receiving the developer from a cartridge storing the developer.

The predetermined image, which is developed on an outer surface of the photoreceptor medium by transferring the developer from the developer roller to the photoreceptor medium, is transferred to the print paper by the transfer unit.

Here, the image formed on the outer surface of the photoreceptor medium is not completely transferred to the print paper by the transfer unit but partially remains on the outer surface of the photoreceptor medium. Since the remaining image disturbs the formation of another latent electrostatic image on the developer roller, it must be eliminated. Usually, it is eliminated from the photoreceptor medium by a cleaning blade installed near the photoreceptor medium. The cleaning blade directly contacts the outer surface of the photoreceptor medium and clears the remaining image off the outer surface. The direct contact between the cleaning blade and the outer surface of the photoreceptor medium causes the photoreceptor medium and the cleaning blade to be worn away, a cleaning efficiency of the cleaning blade is degraded, and maintenance of the photoreceptor medium and the cleaning blade becomes difficult.

Moreover, since it is difficult to maintain a uniform contact between the cleaning blade and the photoreceptor medium, the remaining image may not be satisfactorily, completely or sufficiently eliminated, and a durability of the parts decreases, resulting in an increase in cost.

Particularly, in a case where a high-concentration developer (of about 30–60%) is used, when the cleaning blade contacts the outer surface of the photoreceptor medium before the remaining image on the outer surface is completely dried, toner particles permeate the surface of the cleaning blade made of, for example, polyurethane, having a lower hardness than the photoreceptor medium and adhere thereto, thereby decreasing the cleaning efficiency.

SUMMARY OF THE INVENTION

To solve the above and other problems, it is an object of the present invention to provide an improved photoreceptor medium cleaning device and a method of eliminating a remaining developer from an outer surface of a photoreceptor medium and preventing a wrap-around phenomenon occurring when the remaining developer flows over both ends of the photoreceptor medium.

Additional objects and advantageous of the invention will be set forth in part in the description which follows and, in part, will be obvious from the description, or may be learned by practice of the invention.

To achieve the above and other objects of the present invention, a photoreceptor medium cleaning device eliminating a remaining developer from an outer surface of a photoreceptor medium after a developed image is transferred to a transfer unit in an electrophotographic image forming apparatus includes a magnet which is installed in a lengthwise direction of the photoreceptor medium and is separated (spaced-apart) from the outer surface of the photoreceptor medium, and a magnetic fluid which fills a space formed between the magnet and the outer surface of the photoreceptor medium and closely contacts the outer surface of the photoreceptor medium.

In one aspect of the present invention, the photoreceptor medium cleaning device eliminating the remaining developer from the outer surface of the photoreceptor medium after the developed image is transferred to the transfer unit in the electrophotographic image forming apparatus includes a plurality of magnets each of which is installed in the lengthwise direction of the photoreceptor medium and is separated from the outer surface of the photoreceptor medium and to which magnetic fluids filling corresponding ones of spaces formed between the outer surface of the photoreceptor and corresponding ones of the magnets are fixedly attached.

According to another aspect of the present invention, a method of cleaning the photoreceptor medium includes preparing a magnet, to which the magnetic fluid contacting the outer surface of the photoreceptor medium is fixedly attached, in the lengthwise direction of the photoreceptor medium, and eliminating the remaining developer remaining on the outer surface of the photoreceptor using the magnetic fluid while the photoreceptor medium is rotated.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
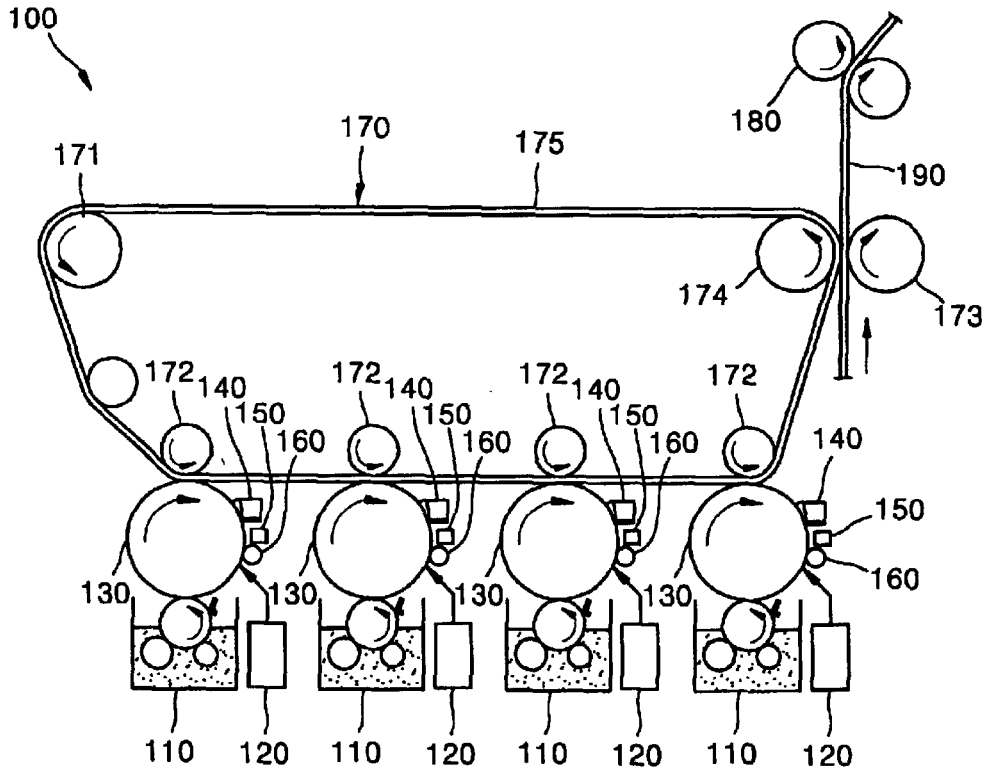
FIG. 1 is a schematic diagram of an electrophotographic image forming apparatus having a photoreceptor medium cleaning device according to an embodiment of the present invention is applied.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Referring to FIG. 1, an electrophotographic image forming apparatus 100 includes development units 110, photoreceptor media 130, a transfer unit 170, and a fusing and fixing unit 180.

Each of the development units 110 applies a developer to a latent electrostatic image formed on the corresponding photoreceptor medium 130 to form an image.

The transfer unit 170 includes a transfer belt 175 which rotates around a driving roller 171, transfer backup rollers 172, and a paper transfer backup roller 174 and to which an image is transferred from the photoreceptor media 130 during rotation, and a paper transfer roller 173 which is installed to face the paper transfer backup roller 174 with the transfer belt 175 disposed therebetween to transfer the image transferred from the transfer belt 175 to print paper 190.

The fusing and fixing unit 180 is installed on a path through which the print paper 190 is discharged, and fuses and fixes the image transferred to the print paper 190 at a predetermined temperature and pressure.

Reference numerals 150 and 160 respectively denote a discharger and an electrostatic charging roller which charges a relevant (corresponding) photoreceptor medium 130. Reference numeral 120 denotes a laser scanning unit (LSU) forming a latent electrostatic image on the relevant photoreceptor medium 130.

Figure 2:
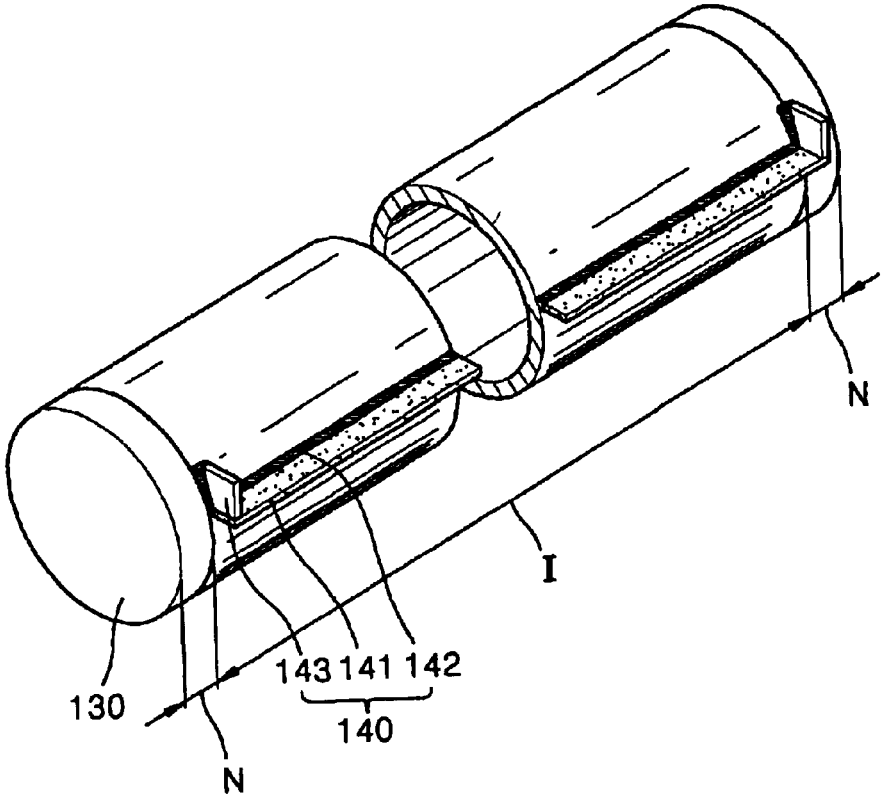
FIG. 2 is a perspective view of the photoreceptor medium cleaning device shown in FIG. 1.
Figure 3:
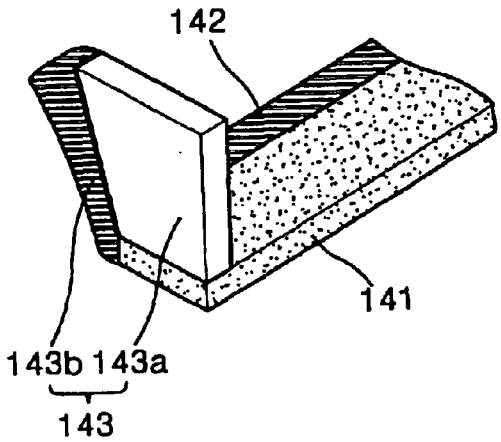
FIG. 3 is a partial perspective view of the photoreceptor medium cleaning device shown in FIG. 1.

FIG. 2 is a perspective view of a photoreceptor medium cleaning device shown in FIG. 1. FIG. 3 is a partial perspective view of the photoreceptor medium cleaning device shown in FIG. 1.

Referring to FIGS. 2 and 3, a photoreceptor medium cleaning device 140 is provided to eliminate a remaining image (developer) remaining on the outer surface of the corresponding photoreceptor medium 130 after the image formed on the outer surface of the photoreceptor medium 130 is transferred to the transfer belt 175. The photoreceptor medium cleaning device 140 includes a magnet 141 and a magnetic fluid (or a ferromagnetic fluid) 142.

The remaining image remaining on the outer surface of the photoreceptor medium 130 is formed with a mixture of toner and a carrier. Since the remaining image contains the carrier, it is in a liquidized state.

The magnet 141 is disposed in a lengthwise direction of the photoreceptor medium 130 and is separated (spaced-apart) from the outer surface of the photoreceptor medium 130. The magnet 141 possesses (generates) a predetermined magnetic force to apply a predetermined pressure to the magnetic fluid 142 filling a space between the photoreceptor medium 130 and the magnet 141.

As is generally known, the magnetic fluid 142 is made by stably scattering ferromagnetic ultra particles into a solvent to be in a colloidal state and adding a surfactant to prevent precipitation or cohesion. In the magnetic fluid 142, the ferromagnetic particles are not separated from a liquid of the magnetic fluid 142 under the influence of a magnetic field, gravity, or a centrifugal force, so it looks like a liquid but acts like it has magnetism within the magnetic field.

Since the magnetic particles contained in the magnetic fluid 142 are attracted to the magnet 141, the magnetic fluid 142 is fixedly attached to the magnet 141. It is possible that the magnet 141 is a permanent magnet having the predetermined magnetic force.

The magnetic fluid 142 is securely attached to the magnet 141 due to the magnetic force of the magnet 141 and closely contacts the outer surface of the photoreceptor medium 130 at the predetermined pressure. Here, a shape of the magnetic fluid 142 is determined in accordance with that of the magnet 141.

When the photoreceptor medium 130 rotates while being in contact with the magnetic fluid 142, the remaining developer remaining on the outer surface of the photoreceptor medium 130 is eliminated from the outer surface of the photoreceptor medium 130.

The photoreceptor medium cleaning device 140 also includes a blocking blade 143 disposed at each of both ends thereof. The blocking blade 143 is disposed at a border between an image region I and a non-image region N of the photoreceptor medium 130 and at respective ones of both ends of the magnet 141 to prevent a wrap-around phenomenon in which some of the remaining developer eliminated from the photoreceptor medium 130 by the magnetic fluid 142 flows into the non-image region N. If the remaining developer flows from the image region I into the non-image region N along the lengthwise direction of the photoreceptor medium 130, the magnetic fluid 142 may contaminate the non-image region N and both ends of the photoreceptor medium 130. The blocking blade 143 includes a magnet 143*a* and a magnetic fluid 143*b*.

The remaining developer eliminated by the magnetic fluid 142 is collected into a developer collector (not shown) installed at a lower end of the magnet 141.

The remaining developer in an attached state is changed to be in a detachable state when being in contact with a surface of the magnetic fluid 142. After passing the surface of the magnetic fluid 142, the remaining developer in the detachable state is easily eliminated from the photoreceptor medium 130 to be collected into the developer collector. It is possible that the developer collector may be a roller disposed adjacent to the magnetic fluid 142 to collect the remaining developer. Thus, the remaining developer in the detachable state is easily transferred from the photoreceptor medium 130 to the developer collector through the magnetic fluid 142. The detached remaining developer flows from the outer surface of the photoreceptor medium 130 to an upper surface of the magnet 141 via the surface of magnetic fluid 142. The detached remaining developer on the upper surface of the magnet 141 is transferred to the development unit through the developer collector. The developer collector is disposed adjacent to a rear side of the magnet 141 and may be an angular or screw type roller.

Figure 4:
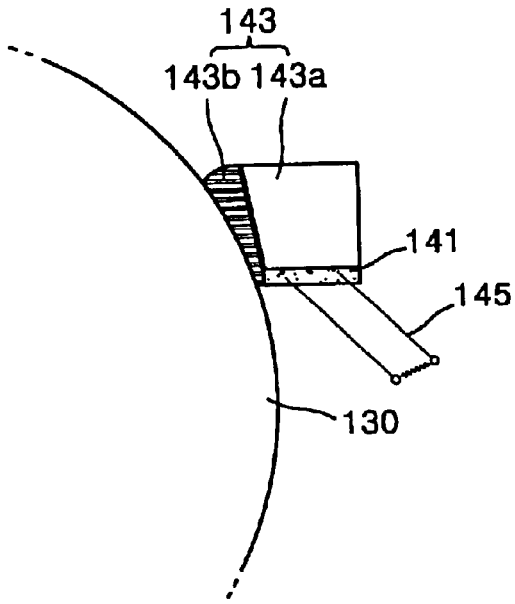
FIG. 4 is a diagram of a photoreceptor medium cleaning device according to another embodiment of the present invention.

FIG. 4 is a diagram of a photoreceptor medium cleaning device according to a second embodiment of the present invention. Referring to FIG. 4, the photoreceptor medium cleaning device has a similar basic structure to the photoreceptor medium cleaning device shown in FIG. 2 but further includes an ultrasonic generator 145.

The ultrasonic generator 145 applies ultrasonic waves, which are generated when current is applied to the magnet 142, to the remaining developer adhering to the outer surface of the photoreceptor medium 130 to vibrate the remaining developer so that the remaining developer can easily come off and be detached from the outer surface of the photoreceptor medium 130.

Accordingly, the remaining developer adhering to the outer surface of the photoreceptor medium 130 is vibrated by the ultrasonic generator 145 and simultaneously contacts the magnetic fluid 142, so it comes off and is detached from the outer surface of the photoreceptor medium 130. By using the ultrasonic generator 145, the remaining developer comes off more easily.

Figure 5:
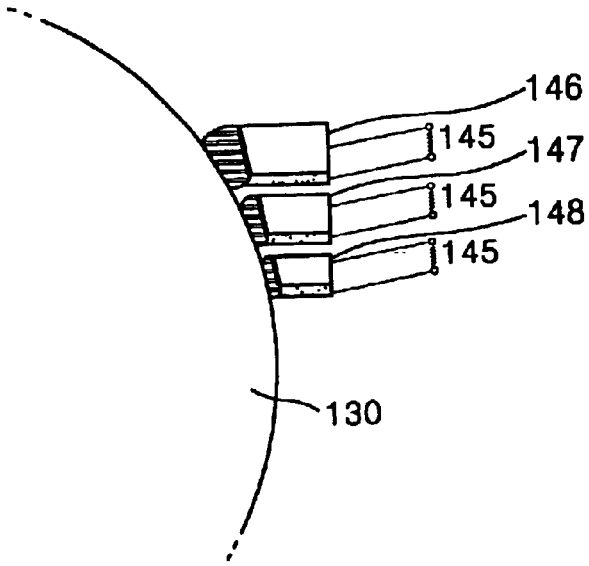
FIG. 5 is a diagram of a photoreceptor medium cleaning device according to another embodiment of the present invention.

FIG. 5 is a diagram of a photoreceptor medium cleaning device according to a third embodiment of the present invention. Referring to FIG. 5, a plurality of photoreceptor medium cleaning devices 140 shown in FIG. 2 are disposed in the lengthwise direction of photoreceptor medium 130 to be separated (spaced apart) from each other at an interval in a rotational direction of the photoreceptor medium 130 while being in contact with the photoreceptor medium 130. Each of the photoreceptor medium cleaning devices 140 includes a first photoreceptor medium cleaning device 146, a second photoreceptor medium cleaning device 147, and a third photoreceptor medium cleaning device 148.

Accordingly, when the photoreceptor medium 130 rotates while being in contact with the first through third photoreceptor medium cleaning devices 146, 147, and 148, the remaining developer adhering to the outer surface of the photoreceptor medium 130 is initially eliminated from the outer surface of the photoreceptor medium 130 by the first photoreceptor medium cleaning device 146. The remaining developer that is not eliminated by the first photoreceptor medium cleaning device 146 is eliminated by the second and third photoreceptor medium cleaning devices 147 and 148.

By using the plurality of the photoreceptor medium cleaning devices 146, 147, and 148 cleaning the photoreceptor medium 130 and being separated from one another while being in contact with the outer surface of the photoreceptor medium 130, the remaining developer adhering to the outer surface of the photoreceptor medium 130 can be more efficiently eliminated than using a single photoreceptor medium cleaning device.

The photoreceptor medium cleaning devices 146, 147, and 148 may have the same magnetic force or different magnetic forces to gradually change the remaining developer from the attached state to the detachable state.

Meanwhile, as shown in FIG. 5, each of the photoreceptor medium cleaning devices 146, 147, and 148 may also include the ultrasonic generator 145 to increase the efficiency in eliminating the remaining developer adhering to the outer surface to the photoreceptor medium 130.

As described above, in a photoreceptor medium cleaning device of an electrophotographic image forming apparatus according to the present invention, a liquid magnetic fluid contacts a liquid developer, thereby preventing abrasion of the photoreceptor medium. Since the liquid magnetic fluid is used as a cleaning agent, the liquid developer is prevented from sticking to the cleaning agent, thereby preventing a decrease in a cleaning efficiency. Since blocking blades are installed at both sides of a photoreceptor medium, a wrap-around phenomenon in which a developer flows over contaminating the photoreceptor medium can be prevented.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A photoreceptor medium cleaning device eliminating a remaining developer from an outer surface of a photoreceptor medium after a developed image of a developer is transferred from the photoreceptor medium to a transfer unit in an electrophotographic image forming apparatus, the photoreceptor medium cleaning device comprising:

a plurality of magnets each of which is installed in a lengthwise direction of the photoreceptor medium and is separated from the outer surface of the photoreceptor medium and to which magnetic fluids filling spaces between the outer surface of the photoreceptor medium and the magnets are attached; and blocking blades which are disposed at corresponding ones of borders between an image region and non-image regions of the photoreceptor medium and at both sides of each of the magnets so that the developer remaining on the outer surface of the photoreceptor medium is prevented from flowing over the photoreceptor medium into the corresponding non-image regions.

2. The photoreceptor medium cleaning device of claim 1, further comprising:

an ultrasonic generator vibrating the remaining developer remaining on the outer surface of the photoreceptor medium.

3. A method of cleaning a photoreceptor medium in an image forming apparatus, the method comprising:

preparing a magnet to which a magnetic fluid contacting an outer surface of the photoreceptor medium is attached, in a lengthwise direction of the photoreceptor medium; and eliminating a remaining developer remaining on the outer surface of the photoreceptor medium using the magnetic fluid while the photoreceptor medium is rotated; and preventing the remaining developer eliminated by the magnetic fluid from flowing into one of both ends of the magnet.

4. A photoreceptor medium cleaning device eliminating a remaining developer from an outer surface of a photoreceptor medium in an electrophotographic image forming apparatus, comprising:

a magnet disposed to be spaced-apart from the outer surface of the photoreceptor medium; and a magnetic fluid disposed in a space between the magnet and the outer surface of the photoreceptor medium to eliminate the remaining developer from the outer surface of the photoreceptor medium, wherein the photoreceptor comprises an image area and a non-image area, and the magnet is disposed over the image area of the outer surface of the photoreceptor medium, and wherein the magnet comprises a block blade disposed over an area between the image area and the non-image area of the photoreceptor medium.

5. The photoreceptor medium cleaning device of claim 4, wherein the magnet generates a magnetic force to securely attach the magnetic fluid to the magnet.

6. The photoreceptor medium cleaning device of claim 4, wherein the magnet is not disposed over the non-image area of the outer surface of the photoreceptor medium.

7. The photoreceptor medium cleaning device of claim 4, wherein the magnetic fluid comprises ferromagnetic ultra particles and a solvent to be in a colloidal state.

8. The photoreceptor medium cleaning device of claim 4, wherein the magnetic fluid comprises ferromagnetic particles and a surfactant to prevent precipitation or cohesion of the ferromagnetic particles.

9. The photoreceptor medium cleaning device of claim 4, wherein the magnetic fluid comprises ferromagnetic particles to fixedly couple the magnetic fluid to the magnet.

10. The photoreceptor medium cleaning device of claim 4, wherein the magnet comprises a first magnet and a second magnet, and the magnetic fluid comprises a first magnetic fluid disposed between the first magnet and the outer surface of the photoreceptor medium and a second magnetic fluid disposed between the second magnet and the outer surface of the photoreceptor medium.

11. The photoreceptor medium cleaning device of claim 10, wherein the first magnet generates a first magnetic force to attach the first magnetic fluid to the first magnet, and the second magnet generates a second magnetic force to attach the second magnetic fluid to the second magnet.

12. The photoreceptor medium cleaning device of claim 11, wherein the first magnetic force is different from the second magnetic force.

13. The photoreceptor medium cleaning device of claim 10, wherein the first magnet is parallel to the second magnet.

14. The photoreceptor medium cleaning device of claim 10, wherein the first magnet is spaced-apart from the second magnet by a predetermined distance in a rotational direction of the photoreceptor medium.

15. The photoreceptor medium cleaning device of claim 4, wherein the block blade is a second magnetic fluid.

16. The photoreceptor medium cleaning device of claim 15, wherein the second magnetic fluid is disposed between the block blade and the outer surface of the photoreceptor medium to prevent the remaining developer from flowing from the image area to the non-image area of the outer surface of the photoreceptor medium.

17. The photoreceptor medium cleaning device of claim 15, wherein the second magnetic fluid of the block blade communicates with the magnet fluid of the magnet.

18. The photoreceptor medium cleaning device of claim 4, wherein the block blade is coupled to the magnet.

19. The photoreceptor medium cleaning device of claim 4, wherein the magnet is disposed along a lengthwise direction of the photoreceptor medium, and the block blade is disposed along a rotational direction of the photoreceptor medium.

20. The photoreceptor medium cleaning device of claim 4, wherein the lengthwise direction is perpendicular to the rotational direction.

21. A photoreceptor medium cleaning device eliminating a remaining developer from an outer surface of a photoreceptor medium in an electrophotographic image forming apparatus, comprising:

a magnet disposed to be spaced-apart from the outer surface of the photoreceptor medium; and a magnetic fluid disposed in a space between the magnet and the outer surface of the photoreceptor medium to eliminate the remaining developer from the outer surface of the photoreceptor medium, wherein the magnet comprises a first magnet and a second magnet, and the magnetic fluid comprises a first magnetic fluid disposed between the first magnet and the outer surface of the photoreceptor medium and a second magnetic fluid disposed between the second magnet and the outer surface of the photoreceptor medium, and wherein the first magnet has a first thickness in a rotational direction of the photoreceptor medium, and the second magnet has a second thickness in the rotational direction, the second thickness being different from the first thickness.

* * * * *